US005396685A

United States Patent [19]

Wilk

[11] Patent Number: 5,396,685

[45] Date of Patent: * Mar. 14, 1995

[54] ZIPPER-TYPE CLOSURE METHOD

[76] Inventor: Peter J. Wilk, 185 West End Ave., New York, N.Y. 10023

[ * ] Notice: The portion of the term of this patent subsequent to Dec. 28, 2010 has been disclaimed.

[21] Appl. No.: 181,667

[22] Filed: Jan. 14, 1994

[51] Int. Cl.[6] ..... A44B 19/00

[52] U.S. Cl. ..... 24/390; 24/388; 24/433

[58] Field of Search ..... 24/433, 434, 436, 390, 24/389, 388, 587, 576, 399, 400

[56] References Cited

U.S. PATENT DOCUMENTS

| | | | |
|---|---|---|---|
| Re. 18,571 | 8/1932 | Avedon | 24/433 |
| 2,263,481 | 11/1941 | Austin | 24/434 |
| 2,511,926 | 6/1950 | Lukas et al. | 24/388 |
| 3,046,627 | 7/1962 | Morin | 24/433 |
| 3,054,434 | 9/1962 | Ausnit et al. | 24/399 |
| 3,775,812 | 12/1973 | Carver, Jr. | 24/390 |
| 4,139,927 | 2/1979 | Heimberger | 24/434 |
| 4,221,026 | 9/1980 | Kanibaka | 24/433 |
| 4,610,057 | 9/1986 | Akashi | 24/433 |
| 4,905,694 | 3/1990 | Will | 24/390 |
| 5,007,145 | 4/1991 | Kim | 24/433 |
| 5,020,194 | 6/1991 | Herrington et al. | 24/389 |
| 5,131,120 | 7/1992 | Akashi | 24/433 |
| 5,272,793 | 12/1993 | Wilk | 24/433 |

FOREIGN PATENT DOCUMENTS

| | | | |
|---|---|---|---|
| 0439744 | 12/1935 | United Kingdom | 24/434 |

*Primary Examiner*—Victor N. Sakran
*Attorney, Agent, or Firm*—R. Neil Sudol; Henry D. Coleman

[57] ABSTRACT

A closure device comprises a zipper, a first elongate coupling element, and a second elongate coupling element lockable along its length to the first elongate coupling element. The zipper is slidably connected to the first elongate coupling element for locking the elongate coupling elements to one another by a closure stroke of the zipper and for alternately unlocking the elongate coupling elements from one another by an opening stroke of the zipper. A first snap lock fastener is connected to the first elongate coupling element at one end thereof, while a second snap lock fastener is connected to the second elongate coupling element at a corresponding end thereof. The snap lock fasteners are releasably connected to one another in snap lock fashion to align the one end of the first elongate coupling element with the corresponding end of the second elongate coupling element, thereby facilitating the closure stroke of the zipper.

2 Claims, 2 Drawing Sheets

ZIPPER-TYPE CLOSURE METHOD

BACKGROUND OF THE INVENTION

This invention relates to a zipper-type closure device.

Zippers on clothing are particularly difficult for young children to use. To close a conventional zipper, a prong or finger at the end of one elongate toothed coupling element must be inserted into a recess at the mouth of the zipper and into a receiving element at the end of the other elongate toothed coupling element. This operation requires a modicum of skill which is generally not available to small children.

OBJECTS OF THE INVENTION

An object of the present invention is to provide a zipper type closure device.

Another object of the present invention is to provide such a zipper assembly which is easier than conventional zippers for young children to use.

Another, more particular, object of the present invention is to provide such a zipper assembly for use on clothing.

Other objects of the present invention will be apparent from the detailed descriptions and drawings included herein.

SUMMARY OF THE INVENTION

A closure device comprises, in accordance with the present invention, a zipper, a first elongate coupling element and a second elongate coupling element lockable along its length to the first elongate coupling element. The zipper is slidably connected to the first elongate coupling element for locking the elongate coupling elements to one another by manipulating the zipper to move the elongate coupling elements towards one another along a plane. The zipper also serves to alternately unlock the first elongate coupling element from the second elongate coupling element: the zipper is manipulated to move the elongate coupling elements apart from one another in or along the plane. A first snap lock fastener is connected to the first elongate coupling element at one end thereof, while a second snap lock fastener is connected to the second elongate coupling element at a corresponding end thereof. The snap lock fasteners are disposed for releasable snap lock interconnection in a direction substantially perpendicular to the plane to align the one end of the first elongate coupling element with the corresponding end of the second elongate coupling element, thereby facilitating a closure stroke of the zipper.

Pursuant to another feature of the present invention, the elongate coupling elements each include a row of zipper teeth. Alternatively, the elongate coupling elements each take the form of an extruded polymeric strip, one strip having a locking bead and the other strip being provided with a locking groove receiving the bead.

Pursuant to a further feature of the present invention, the first snap lock fastener includes a recess and the zipper includes a portion receivable in the recess prior to a snapping of the first snap lock fastener to the second snap lock fastener.

A closure device in accordance with the present invention is designed particularly for attachment to an article of clothing, specifically children's clothing.

The second snap lock fastener may be connected to the second elongate coupling element via a substantially rigid spacer bar to provide an opening between the end of the second elongate coupling element and the second snap lock fastener to receive a head portion of the zipper during a snapping of the first snap lock fastener to the second snap lock fastener.

A method for closing an article of clothing comprises, in accordance with the present invention, the step of pulling a zipper in a first direction along a first elongate coupling element to one end thereof. The first elongate coupling element is attached to an edge of the article of clothing which is substantially planar at least in a region about the one end of the first elongate coupling element. In another step, a first snap lock fastening element disposed at the one end of the first elongate coupling element is snapped to a second snap lock fastening element disposed at an end of a second elongate coupling element to interlock the first snap lock fastening element to the second snap lock fastening element and to concomitantly align the one end of the first elongate coupling element with the end of the second elongate coupling element, thereby facilitating a closure stroke of the zipper. The step of snapping includes the step of moving the first snap lock fastening element and the second snap lock fastening element towards one another in a direction substantially perpendicular to the article of clothing or perpendicular to a plane defined by the article of clothing at the ends of the elongate coupling elements. Subsequently, the zipper is pulled in a second direction opposite to the first direction to lock the first elongate coupling element to the second elongate coupling element along at least a portion of the length thereof.

Pursuant to another feature of the present invention, the step of pulling the zipper in the first direction includes the step of inserting a portion of the zipper into a recess in the first snap lock fastening element.

A zipper type closure device in accordance with the present invention is easier to use than conventional zippers and particularly easier to start than conventional zippers. Accordingly, a zipper assembly in accordance with the present invention is particularly suitable for incorporation into clothing for young children.

DETAILED DESCRIPTION

Figure 1A:
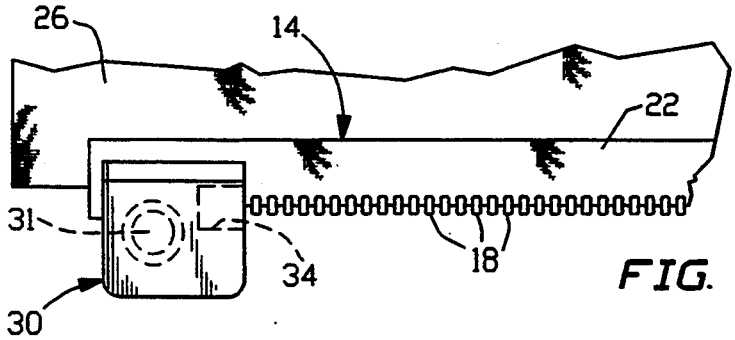
FIGS. 1A and 1B are top or plan views of two cooperating portions of a zipper assembly in accordance with the present invention.
Figure 1B:
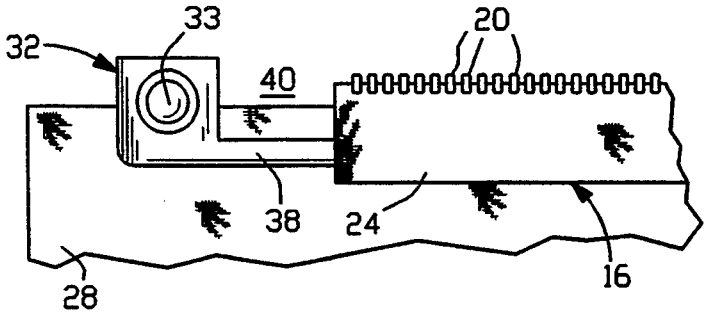
Figure 2:
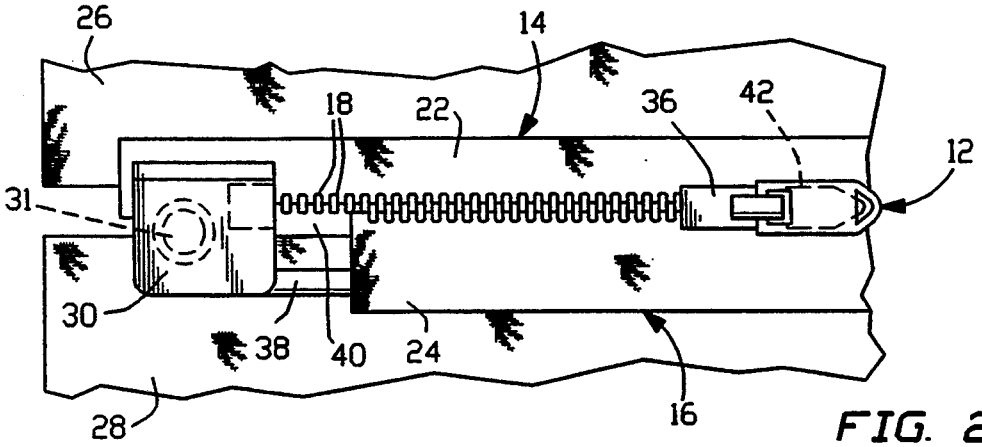
FIG 2 is a top or plan view of the two cooperating zipper portions of FIGS. 1A and 1B, connected to one another.

As illustrated in FIGS. 1A, 1B, and 2, a zipper-type closure device comprises a zipper 12 (FIG. 2), a first elongate coupling element 14, and a second elongate coupling element 16 lockable along its length to coupling element 14 via intermeshing teeth 18 and 20 provided on elongate coupling elements 14 and 16, respectively. Each coupling element 14 and 16 further includes a woven fabric strip 22 and 24 to which teeth 18 and 20 are connected. Fabric strips 22 and 24 are sewn or otherwise secured to respective flaps or edges 26 and 28 of an article of clothing.

Zipper 12 is slidably connected to coupling element 14. A closure stroke of zipper 12 serves to bring teeth 18 and 20 into intermeshing interdigitation, thereby linking coupling elements 14 and 16 to one another. Coupling elements 14 and 16 are unlocked from one another by an opening stroke of zipper 12 in an opposite direction to the closure stroke.

A first snap lock fastener 30 is connected to coupling element 14 at one end thereof, while a second snap lock fastener 32 is connected to coupling element 16 at a corresponding end thereof. Fasteners 30 and 32 include ball-and-socket-type elements 31 and 33 releasably connected to one another in snap lock fashion to align the one end of coupling element 14 with the corresponding end of coupling element 16, thereby facilitating a closure stroke of zipper 12.

Snap lock fastener 30 includes a recess 34 which receives a trailing portion or back end 36 of zipper 12 upon an opening stroke of zipper 12 in a direction along coupling element 14 towards snap lock fastener 30. The reception of trailing portion or back end 36 into recess 34 occurs on some occasions prior to a snapping of fasteners 30 and 32 to one another.

Second snap lock fastener 32 is connected to coupling element 16 via a substantially rigid spacer bar 38 to provide an opening 40 between the end of coupling element 16 and fastener 32, wherein a head portion 42 of zipper 12 is received during a snapping of fastener 30 to fastener 32.

Figure 3:
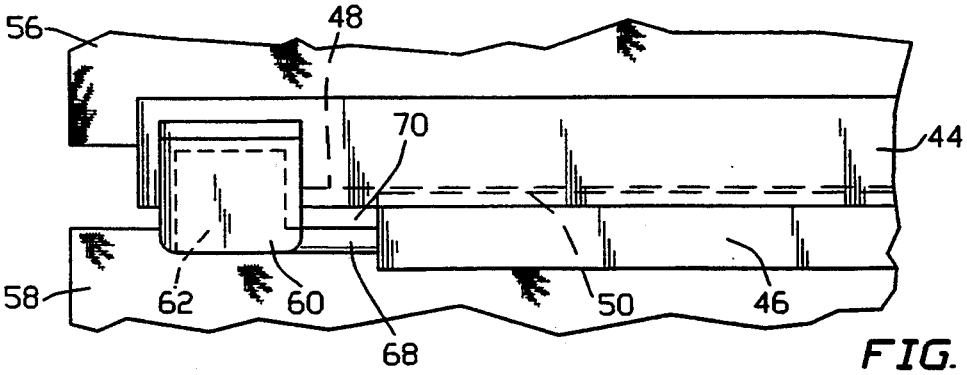
FIG. 3 is a top or plan view of another two cooperating zipper portions in accordance with the present invention, showing the zipper portions connected to one another.

FIG. 3 illustrates a zipper-type closure device comprises a zipper (not shown), a first elongate coupling element 44 in the form of an extruded polymeric strip, and a second elongate coupling element 46 also in the form of an extruded polymeric strip. Polymeric strips 44 and 46 are lockable along their lengths to one another via an intermeshing groove or slot 48 and a bead 50 provided on strips 44 and 46, respectively. Each strip 44 and 46 is adhesively bonded or otherwise secured to respective flaps or edges 56 and 58 of an article of clothing.

The zipper is slidably connected to strip 44. A closure stroke of the zipper serves to bring bead 50 into groove 48, thereby linking strips 44 and 46 to one another. Strips 44 and 46 are unlocked from one another by an opening stroke of the zipper in a direction opposite to the closure stroke.

A first snap lock fastener 60 is connected to strip 44 at one end thereof, while a second snap lock fastener 62 is connected to strip 46 at a corresponding end thereof. Fasteners 60 and 62 are ball-and-socket-type fasteners releasably connected to one another in snap lock fashion to align the one end of strip 44 with the corresponding end of strip 46, thereby facilitating a closure stroke of the zipper.

Second snap lock fastener 62 is connected to strip 46 via a substantially rigid spacer bar 68 to provide an opening 70 between the end of strip 46 and fastener 62, wherein a head portion of the zipper is received during a snapping of fastener 60 to fastener 62.

In using the zipper-type fastening assembly of FIGS. 1A, 1B, and 2, zipper 12 is pulled in a first direction along coupling element 14 to one end thereof. Fastener 30 is snapped to fastener 32 to interlock the fasteners and to concomitantly align the one end of coupling element 14 with the end of coupling element 16, thereby facilitating a closure stroke of the zipper. Zipper 12 is pulled in a second direction opposite to the first direction to lock the coupling elements 14 and 16 to one another along at least a portion of their lengths.

Figure 4:
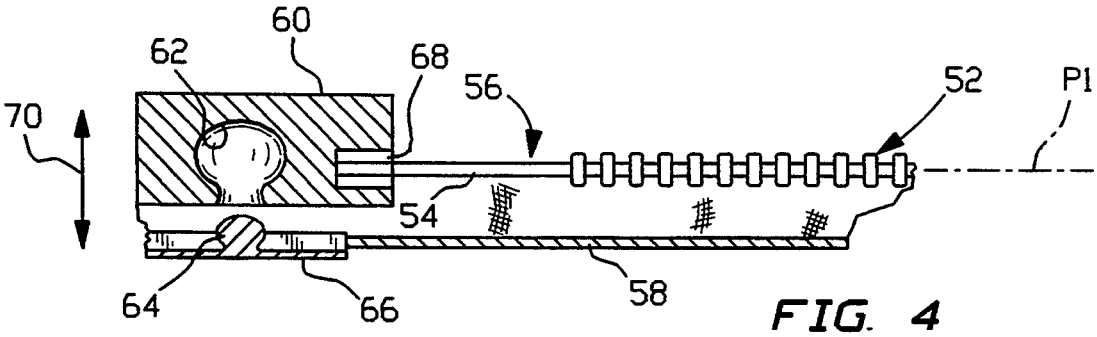
FIG. 4 is a schematic cross-sectional view of snap lock components of a zipper assembly in accordance with the present invention, illustrating a method of using the zipper assembly.

FIG. 4 depicts a closure device similar to the combination zipper and snap-lock fastener shown in FIGS. 1A, 1B, and 2. FIG. 4 shows a first elongate toothed coupling element 52 attached to an edge 54 of an article of clothing 56 disposed in and defining a plane P1. FIG. 4 omits a zipper slidably connected to toothed coupling element 52. FIG. 4 also omits a second elongate coupling element which is attached along a second edge 58 of the article of clothing. During use of the zipper type closure device of FIG. 4 (as well as the closure device of FIGS. 1A, 1B, and 2 and the closure device of FIG. 3) the zipper is manipulated to move the elongate coupling elements towards one another along or in plane P1. The zipper also serves to unlock the coupling elements from one another: the zipper is manipulated to move the elongate coupling elements apart from one another in or along plane P1.

As further depicted in FIG. 4, a first snap lock fastener 60 is connected to coupling element 52 at one end thereof. Snap lock fastener 60 may be connected to the zipper coupling element 52 via the fabric of the article of clothing. Snap lock fastener 60 includes a recess or socket 62 for receiving a ball-type projection 64 on a second snap lock fastener 66 which is attached to the article of clothing along edge 58.

As described hereinabove with reference to FIG. 1A, snap lock fastener 60 includes a recess 68 which receives a trailing portion or back end of the zipper upon an opening stroke of zipper in a direction along coupling element 52 towards snap lock fastener 60. The reception of the trailing portion or back end into recess 68 occurs on some occasions prior to a snapping of fasteners 60 and 66 to one another.

Snap lock fasteners 60 and 66 are disposed for releasable snap lock interconnection in a direction, designated by double headed arrow 70, which is substantially perpendicular to plane P1 to align the one end of the first elongate coupling element 52 with the corresponding end of the second elongate coupling element, thereby facilitating a closure stroke of the zipper.

This same procedure pertains to the use of the zipper and snap-lock fastener assembly of FIGS. 1A and 1B.

Figure 5:
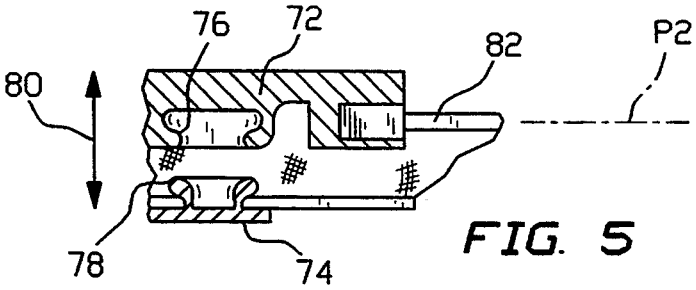
FIG. 5 is a schematic cross-sectional view similar to FIG. 4, showing an equivalent snap lock type connector assembly in accordance with the present invention.

FIG. 5 shows a pair of cooperating snap lock type connectors 72 and 74 which function in the same way as ball and socket connectors 60 and 66 of FIG. 4 and ball and socket connectors 30 and 32 of FIG. 1A and 1B. Each connector 72 and 74 is in the form of a shallow cup. Socket type connector 72 has an inwardly projecting lip 76 which cooperates in snap lock fashion with an outwardly protruding lip 78 of ball type connector 74 upon a moving of the connectors 72 and 74 towards one another in a direction 80 substantially perpendicular to the plane P2 of fabric 82 of an article of clothing.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are profferred by way of example to facilitate comprehension of the invention and should not be construed to limit the scope thereof.

What is claimed is:

1. A method for closing an article of clothing, comprising the steps of:

pulling a zipper in a first direction along an elongate coupling element to one end thereof, said first elongate coupling element being attached to an edge of the article of clothing, said article of clothing being substantially planar at least in a region about said one end of said first elongate coupling element;

snapping a first snap lock fastening element disposed at said one end to a second snap lock fastening element disposed at an end of a second elongate coupling element to interlock said first snap lock fastening element to said second snap lock fastening element and to concomitantly align said one end of said first elongate coupling element with said end of said second elongate coupling element, thereby facilitating a closure stroke of said zipper, said step of snapping including the step of moving said first snap lock fastening element and said second snap lock fastening element towards one another in a direction substantially perpendicular to the article of clothing; and pulling said zipper in a second direction opposite to said first direction to lock said first elongate coupling element to said second elongate coupling element along at least a portion of the length thereof.

2. The method defined in claim 1 wherein said step of pulling said zipper in said first direction includes the step of inserting a portion of said zipper into a recess in said first snap lock fastening element.

* * * * *